United States Patent [19]

Boyadjieff et al.

[11] 4,437,524

[45] Mar. 20, 1984

[54] WELL DRILLING APPARATUS

[75] Inventors: George I. Boyadjieff, Anaheim; Joseph A. R. Picard, Fountain Valley, both of Calif.

[73] Assignee: Varco International, Inc., Orange, Calif.

[21] Appl. No.: 350,081

[22] Filed: Feb. 18, 1982

Related U.S. Application Data

[63] Continuation of Ser. No. 167,758, Jul. 14, 1980, abandoned.

[51] Int. Cl.[3] ..... E21C 11/00

[52] U.S. Cl. ..... 173/43; 175/52

[58] Field of Search ..... 173/42–44, 173/57; 175/52

[56] References Cited

U.S. PATENT DOCUMENTS 3,835,940 9/1974 Winter ..... 175/52 X 4,262,754 4/1981 Nelson ..... 173/43

OTHER PUBLICATIONS

Descriptive Data Bowen ES-7 Electric Drilling Swivel, Bowen Tools Inc., Houston, Tex., Jul. 1974.

*Primary Examiner*—E. R. Kazenske

*Assistant Examiner*—Douglas D. Watts

*Attorney, Agent, or Firm*—William P. Green

[57] ABSTRACT

A well drilling system designed to eliminate the usual rotary table, kelly and kelly bushing, and including a drilling unit having a tubular part connectible to the upper end of the drill string and a motor for driving that tubular part rotatively, with the drilling unit being mounted by a guide structure for vertical movement, and in addition being mounted for movement transversely of the axis of the well from the normal drilling position to at least one laterally offset position. Preferably, the drilling unit is movable to two different laterally offset positions, in one of which the drilling unit is above a mousehole location to pick up or release a pipe section, and in the other of which the drilling unit is at an inactive location at which it may remain during a trip of the drill string into or out of the well.

22 Claims, 14 Drawing Figures

WELL DRILLING APPARATUS

This application is a continuation of application Ser. No. 6/167,758, filed July 14, 1980 now abandoned.

BACKGROUND OF THE INVENTION

This invention relates to improved well drilling apparatus of a type adapted to eliminate the necessity for a rotary table, kelly or kelly bushing.

Conventional rotary drilling as practiced for many years has required the use of a rotary table containing an opening through which a noncircular kelly pipe extends for engagement with a kelly bushing mounted in the table, in a relation driving the kelly bushing and connected drill string rotatively while permitting downward advancement of the kelly relative to the table. Alternative drilling systems have been proposed in which the drive to the pipe string has been derived from a drilling unit including a section of pipe connectable to the upper end of the drill string, and a motor for driving that pipe rotatively to turn the string. This entire powered drilling assembly may then move upwardly and downwardly with the string to drive the string very directly and positively and without the necessity for a kelly and kelly bushing type connection.

SUMMARY OF THE INVENTION

Drilling apparatus embodying the present invention utilizes a direct drive arrangement of this general type, but which is specially designed to facilitate the connection of additional pipe sections into the pipe string, and the removal of sections from the string. The powered drive unit of the apparatus can itself function as a portion of the pipe handling equipment, moving pipe sections between a mousehole location and the axis of the well during drilling, and can be removed to a retracted inactive position during a trip of the string into or out of the well.

The powered drilling unit, including a preferably tubular rotary element connectable to the drill string and a drive motor, and also desirably including a swivel connected to the upper end of the rotary element to supply drilling fluid thereto, is guided for movement along the axis of the well by a guide structure extending parallel to that axis. In addition to this movement longitudinally of the well, the drilling unit is also mounted for movement generally transversely of the well axis, between a drilling position of alignment with the drill string and at least one and preferably two laterally offset positions. In one of those positions, at one side of the well axis the drilling unit is positioned over a mousehole location, to pick up a stand of pipe, which may typically be either a single, double or triple joint stand, and then lift that pipe from the mousehole and move it laterally back to alignment with the drill string for connection thereto. The second of the laterally offset positions may be at a different side of the well axis, at the usual rat hole location, at which the drilling unit may be retained in an inactive position during a trip of the string into or out of the well.

The drilling unit may be mounted for its movement longitudinally of the guide structure by a carriage structure, desirably including two carriage units moving along two vertical guide tracks. The shifting movement of the drilling unit transversely of the well axis may be attained by mounting the drilling unit for transverse or horizontal movement relative to the mentioned carriage structure, with this movement being effected by appropriate motor means, and with the drilling unit being releasably retainable in its drilling position by latch means.

The movement of the drilling unit to the other laterally offset position, desirably at the usual rat hole location, may be attained by mounting a lower portion of the guide structure itself for lateral preferably swinging movement relative to the upper portion of the guide structure and with the carried drilling unit.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
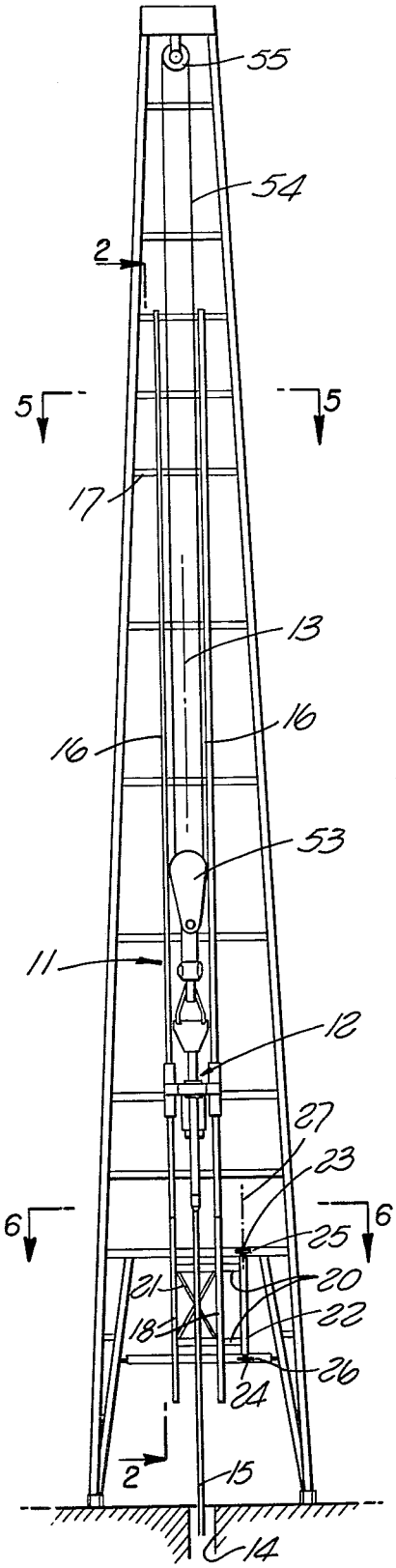
FIG. 1 is a vertical section through a drill rig embodying the invention and taken on line 1—1 of FIG. 2.
Figure 2:
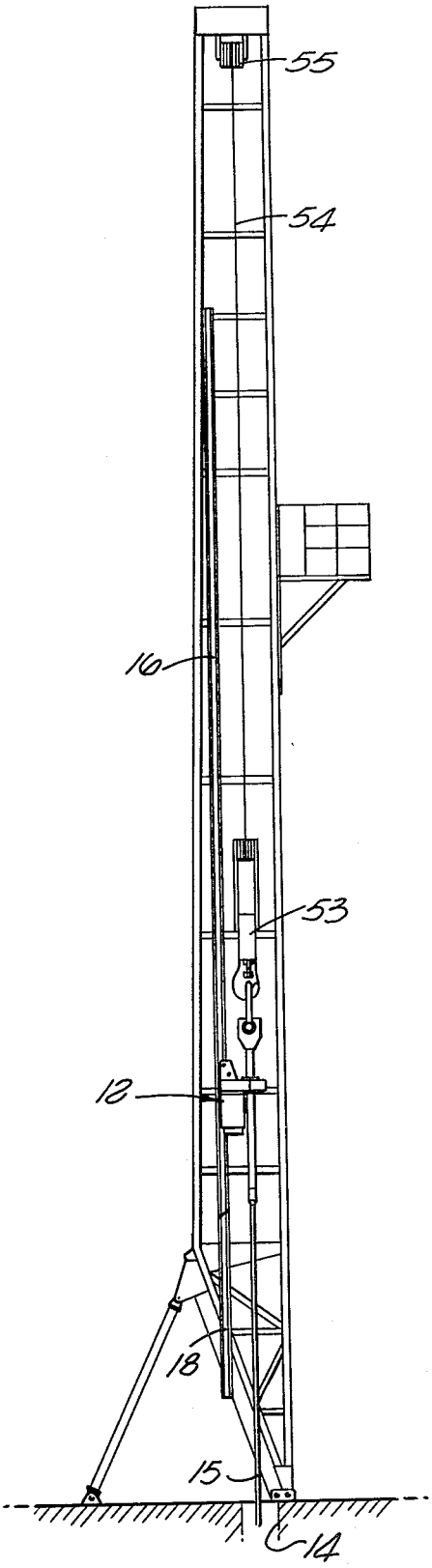
FIG. 2 is a vertical section taken on line 2—2 of FIG. 1.
Figure 11:
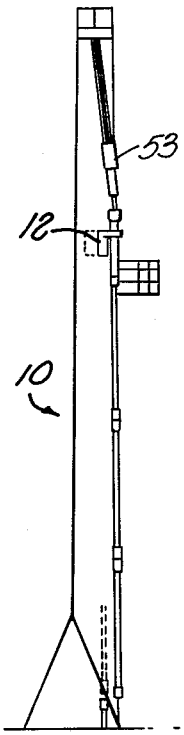
Figure 12:
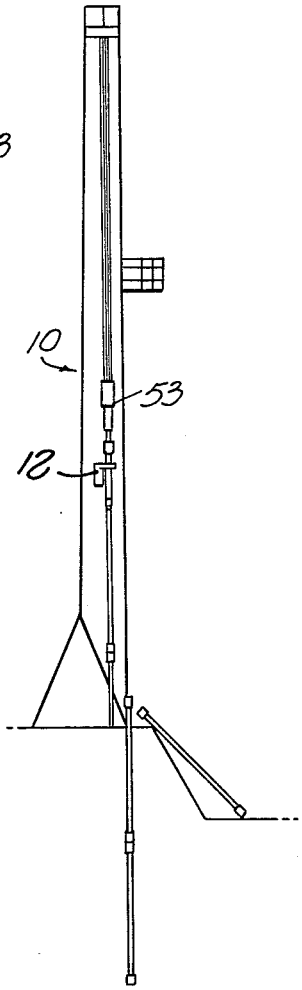

With reference first to FIGS. 1 and 2, there is illustrated somewhat diagrammatically at 10 a conventional well drilling mast to which apparatus embodying the invention has been mounted. The term "mast" as used in this description and in the claims is intended to include broadly any type of upwardly projecting mast or derrick serving the function of the structure shown at 10 in the drawings. The drilling equipment includes a vertical guide structure 11 and a powered drilling unit or sub 12 mounted by the guide structure for movement along the vertical axis 13 of the well 14 and the tubular sectionally formed drill string 15 therein. The drilling unit is also mounted for movement from its FIGS. 1 and 2 normal position of alignment with the drill string to a forwardly offset position represented in FIG. 11 and a laterally offset position represented in FIG. 13.

Figure 4:
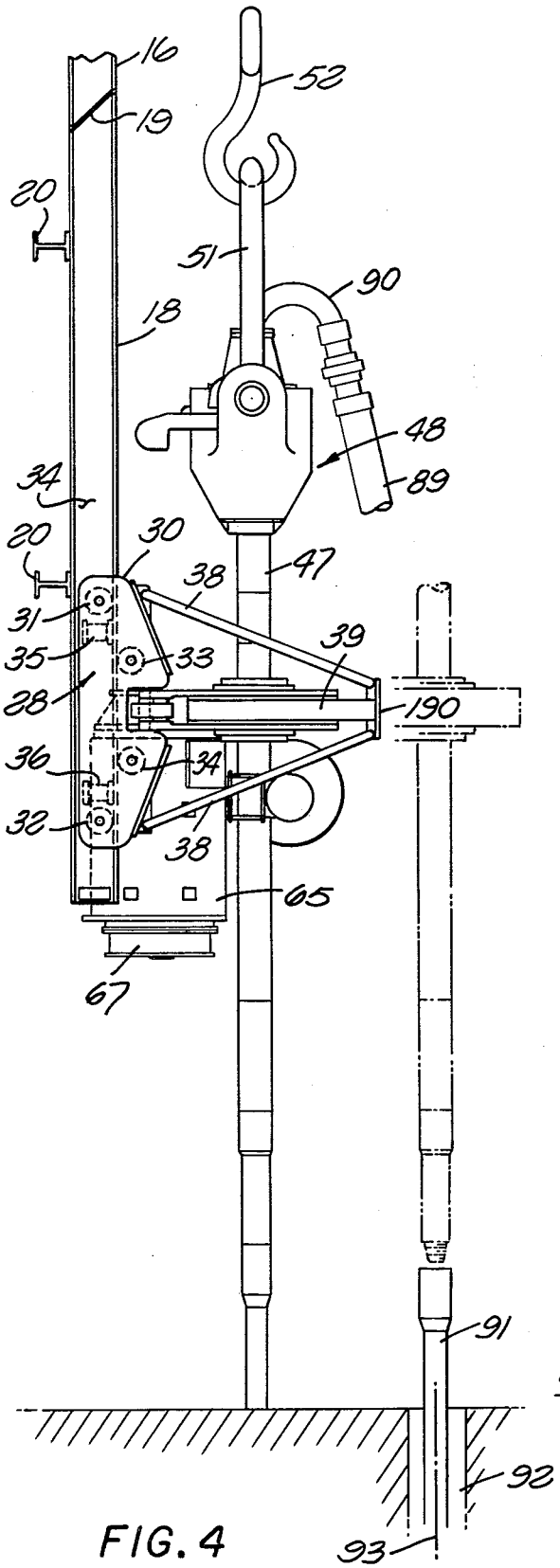
FIG. 4 is a view taken on line 4—4 of FIG. 3.
Figure 5:
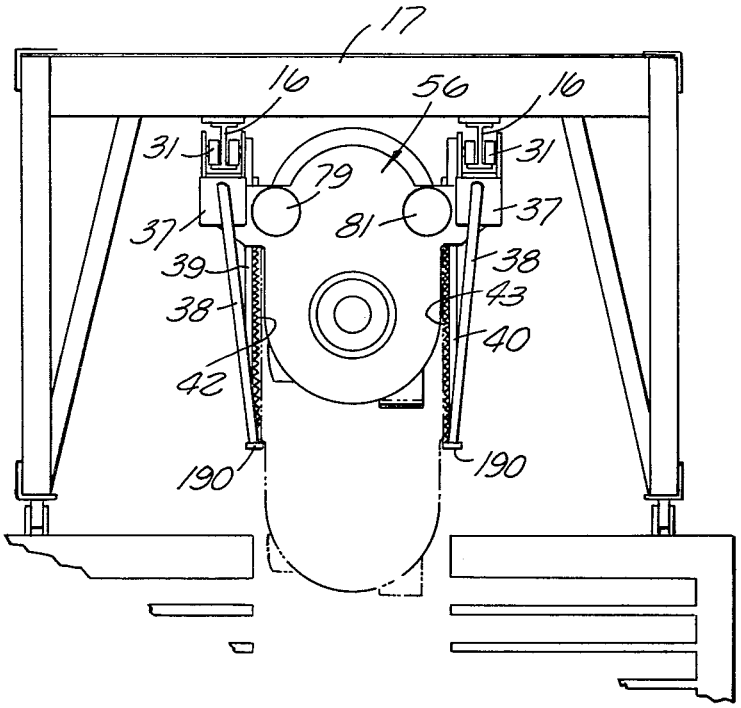
FIGS. 5 and 6 are horizontal sections taken on lines 5—5 and 6—6 respectively of FIG. 1.

The guide structure 11 includes two upper guide rails 16 which extend parallel to one another and to vertical axis 13 and may have the cross-section illustrated in FIG. 5, and which are rigidly secured at spaced locations to horizontal members 17 of the mast. Beneath rails 16, the guide structure includes two shorter lower rails 18 of the same cross-section as upper rails 16 and aligned vertically therewith in the normal drilling position of FIGS. 1 and 2 to form lower continuations of rails 16 typically meeting the latter at inclined edges 19 (FIG. 4).

Figure 6:
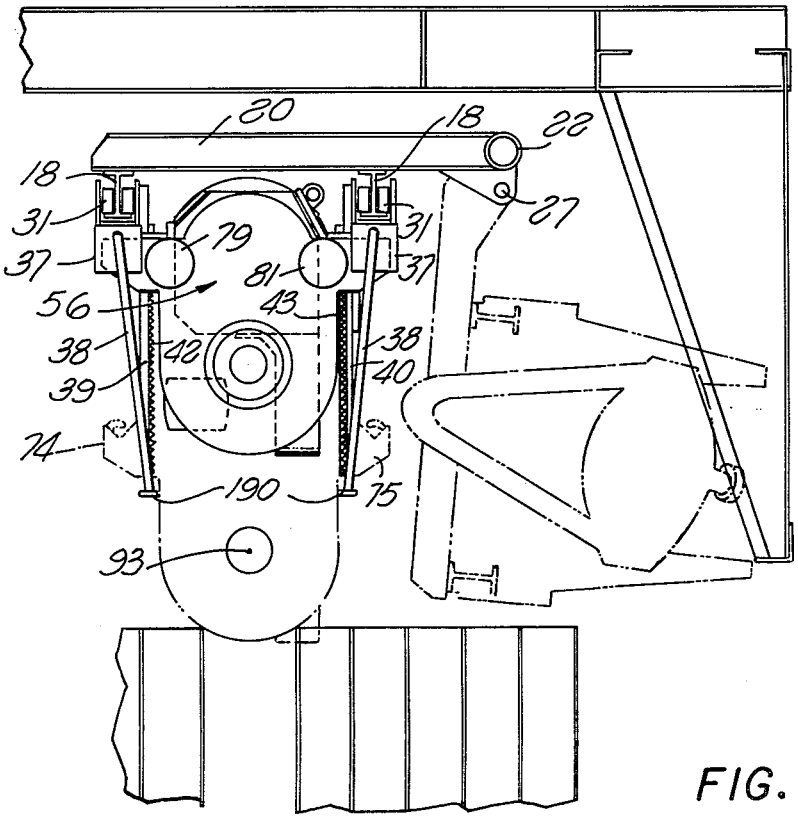

The lower rails 18 are not rigidly secured to the mast, but rather are connected together as an integral structure, as by welding them to horizontal elements 20 and diagonal braces 21, with this entire framework being rigidly connected to a vertical member 22 having upper and lower aligned vertical pins 23 and 24 receivable within openings in bearing elements 25 and 26 mounted stationarily to the mast, in a relation mounting the two lower rail elements 18 and their connected parts for swinging movement about a vertical axis 27 between the active full line position of FIG. 6 and the inactive broken line position of that figure.

The drilling unit is mounted for its vertical movement by two similar carriage or track follower assemblies 28 and 29, each of which includes two spaced parallel vertical side plates 30 having the outline configuration illustrated in FIG. 4 and received at opposite sides of the corresponding rail 16 or 18. These two plates 30 of each carriage 28 or 29 are rigidly secured together in any appropriate manner, and carry rollers coacting with tracks 16 and 18 to guide the carriages for only vertical movement relative thereto. More particularly, as seen in FIGS. 4, 5 and 6, each of the carriages includes two pairs of rollers 31 and 32 mounted to the side plates 30 and engaging the back sides of the front flanges of the I-shaped beams or tracks 16 and 18, with the rollers also including two additional pairs of rollers 33 and 34 between plates 30 engaging the fronts of the same flanges. All of the rollers 31, 32, 33 and 34 are mounted to the carriage plates 30 for rotation about parallel horizontal axes enabling the rollers to roll upwardly and downwardly along the tracks with the flanges confined therebetween in effective guiding relation. At opposite sides of the main web 34 of tracks 16 and 18, the carriage plates 30 rotatably mount additional pairs of rollers 35 and 36 confining the web 34 therebetween and thus retaining the carriages against lateral movement as they roll upwardly and downwardly.

Figure 3:
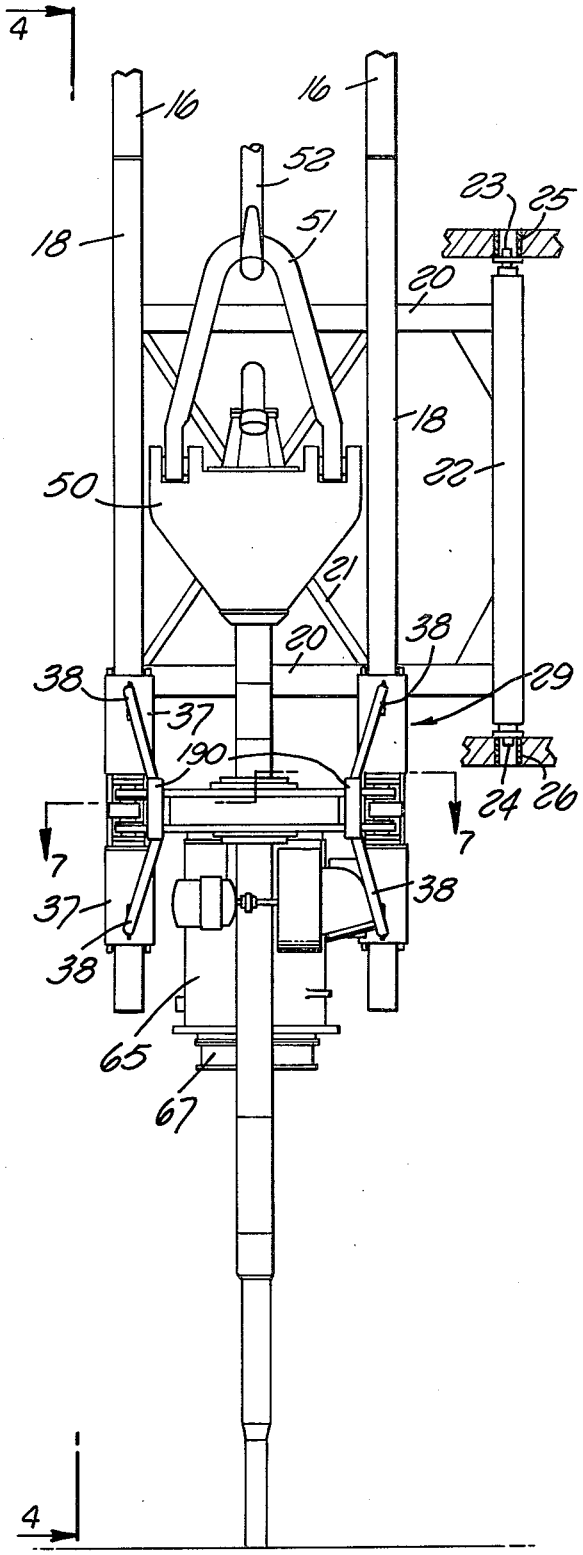
FIG. 3 is an enlarged view corresponding to a lower portion of FIG. 1, but with the drilling unit in its lowered position.
Figure 7:
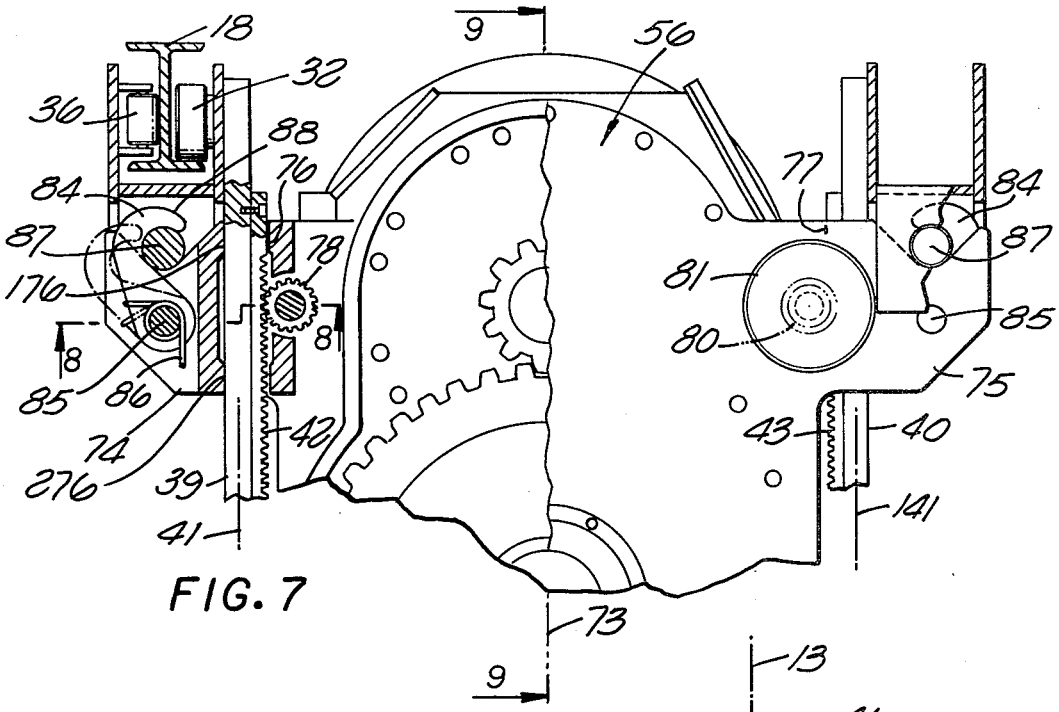
FIG. 7 is a section taken essentially on line 7—7 of FIG. 3.
Figure 8:
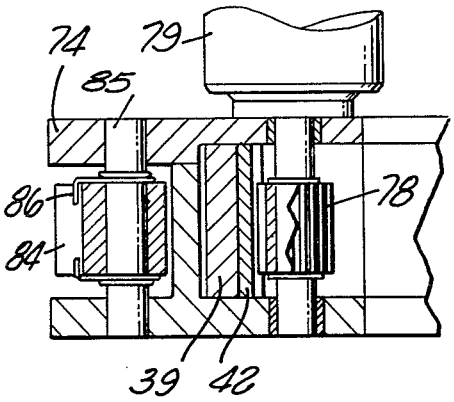
FIG. 8 is a fragmentary vertical section taken on line 8—8 of FIG. 7.

The outer edges of plates 30 of each carriage 28 or 29 are secured together by plates 37 (FIG. 3), to which angular brace members 38 are rigidly secured. The outer ends of brace members 38 of the two carriage structures are connected to the outer extremities of two elongated horizontal guide members 39 and 40, whose longitudinal axes 41 and 141 are parallel to one another (FIG. 7). The inner extremities of the two members 39 and 40 are appropriately rigidly welded or otherwise secured to plates 30 of their respective carriages, to be integral therewith. The vertical transverse cross-sectional configuration of guide member 39 may be as represented in FIG. 8, typically being of essentially rectangular vertical section and having a series of rack teeth 42 extending along the inner side of member 39. The second member 40 may be of similar vertical section, but have its rack teeth 43 formed at the left side of member 40 rather than at the right side as in the case of member 39.

The drilling unit 12 includes a vertical pipe section or sub 44 having a lower externally threaded pin portion 45 connectable into the upper end of drill string 15, and having an upper internally threaded box end 46 into which the externally threaded rotatable stem 47 of a conventional swivel 48 is connectable. Pipe section 44 contains a vertical passage 49 through which circulating fluid flows downwardly from the stem 47 of the swivel to the drill string for discharge at the location of the bit, and for flow upwardly about the outside of the string during a drilling operation. The non-rotating swivel body 50 has a bail 52 connectable to the suspending hook 52 of a traveling block 53, which is adapted to be raised and lowered in conventional fashion by lines 54 extending about pulley wheels of the traveling block 53 and the upper crown block 55.

Figure 9:
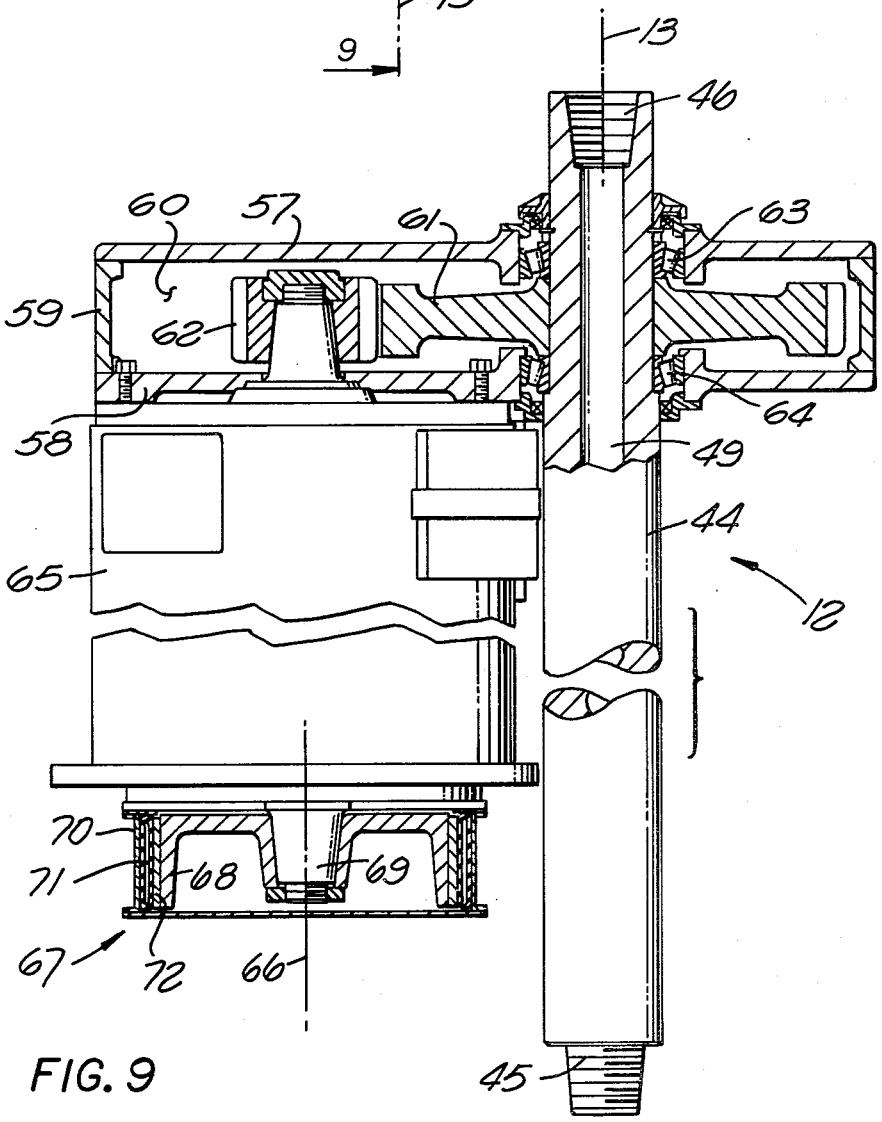
FIG. 9 is a vertical section taken partially on line 9—9 of FIG. 7.

The rotary pipe section 44 is mounted rotatably to a body 56 of the drilling unit, which body may be formed sectionally as illustrated in FIG. 9 of top and bottom walls 57 and 58 and peripheral walls 59 all appropriately bolted or otherwise secured together to define an interior chamber 60 within which gears 61 and 62 are mounted. Two oppositely disposed roller thrust bearings 63 and 64 mount the part 44 for its desired rotation relative to bodies 56 about vertical axis 13, and gear 61 is rigidly secured to part 44, and keyed rotatively thereto, for rotation with part 44. The second and smaller gear 62 is connected to the drive shaft of a preferably electric motor 65, which is secured to the underside of bottom wall 58 of body 56 with its axis 66 extending parallel to vertical axis 13. A brake 67 may be carried at the underside of the motor for applying braking force to prevent rotation of the motor and the part 44 when desired. This brake may include an externally cylindrical drum 68 rigidly secured to lower end 69 of the motor shaft, with a non-rotating cylindrical housing 70 being disposed about the drum and an annular inflatable bladder 71 being confined within housing 70 and actuating cylindrically curving brake shoes 72 inwardly against drum 68 when the bladder is inflated.

The drilling unit is mounted for horizontal sliding movement relative to carriages 28 and 29 along a horizontal axis 73 which is parallel to axes 41 and 141 (FIG. 7). To mount the drilling unit for this purpose, the body 56 of that unit is provided with two oppositely laterally projecting ears 74 and 75, containing guideway passages 76 and 77 within which the two parallel guides 39 and 40 are slidably received. The guideway 76 has a cross-section at locations 176 and 276 to closely slidably receive member 39, with the teeth of a pinion wheel 78 driven by a motor 79 secured to body 56 being in engagement with the rack teeth 42 to power actuate body 56 and the carried parts between the full line and broken line positions of FIG. 6. The guideway 77 similarly closely slidably receives member 40, with a pinion 80 driven by a second motor 81 engaging the rack teeth 43 to assist in powered actuation of the drilling unit between its two FIG. 6 positions. These two motors 79 and 81 may be energized in controlled unison, to drive their pinions simultaneously and at corresponding rates, to thereby apply equal actuating forces at opposite sides of the drilling unit. The two motors 79 and 81 are reversible to power actuate the drilling unit in either direction.

The body 56 of the drilling unit is releasably retainable in the full line position of FIG. 6, in which rotary pipe section 44 is aligned with and adapted to drive the drill string, with this retention being effected by a pair of latch elements 84 mounted by pins 85 attached to ears 74 and 75 for swinging movement about parallel vertical axes between the active full line positions of FIG. 7 and the inactive broken line positions of that figure. Springs 86 yieldingly urge the latches to their active full line positions, in which the latches engage vertical pins 87 rigidly secured to the bodies of the carriages 28 and 29. When the drilling unit is moved toward its full line position of FIG. 6, pins 87 engage camming surfaces 88 on the latches in a manner deflecting them toward their broken line positions to pass the pins, following which the springs 86 return the latches to their full line positions to then positively retain the drilling unit in its inner position adjacent the carriages. The latch elements may be releasable either manually or by powered means.

To describe the use of the illustrated equipment, assume that the apparatus is initially in the condition of FIG. 1, with the rotary pipe section 44 of the drilling unit connected threadedly to the upper end of drill string 15, and with the lower track elements 18 in their position of alignment with upper track sections 16. Drilling fluid is supplied to swivel 48 through a flexible hose 89 connected to gooseneck 90, and flows downwardly through section 44 and the drill string to the bit. As motor 65 drives member 44 rotatively through gears 61 and 62, the rotation of element 44 drives the drill string and bit to drill the hole progressively more deeply into the earth. As the drilling unit moves downwardly from the FIG. 1 position, the carriages 28 and 29 ultimately reach the location of the lower guide rails or tracks 18, and move onto those tracks and are directed downwardly thereby to the FIG. 3 position at which it becomes desirable to connect another stand of drill pipe into the string. With the apparatus in the FIG. 3 condition, the threaded joint between rotary drive section 44 of the drilling unit and the upper section of the drill string is broken, and completely spun out by left-hand rotation of section 44. The initial joint breaking rotation and the spinning action may both be attained by an auxiliary joint making and breaking unit, or alternatively the spinning action may be accomplished by utilizing a reversible motor at 65 and reversing its direction of rotation for unscrewing part 44 from the string.

Figure 10:
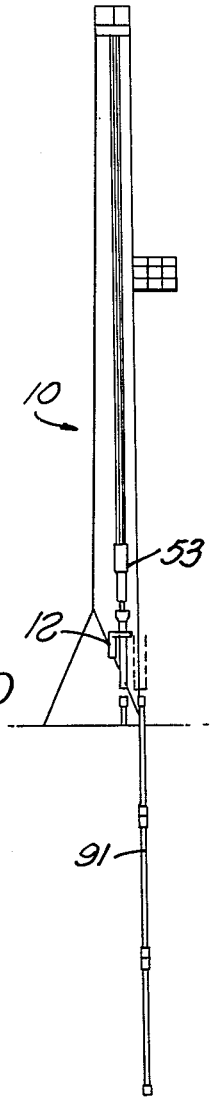
FIGS. 10, 11 and 12 are diagrammatic side view representations of the condition of the apparatus at different stages during the drilling operation.

After the drilling unit has thus been disconnected from the upper end of the string, as represented in full lines in FIG. 10, the drilling unit is actuated from that position above the upper end of the drill string to the broken line position of FIGS. 6 and 10, by releasing latch elements 84 and energizing motors 79 and 81, so that the pinions driven by those motors act against racks 42 and 43 to shift the drilling unit outwardly. This motion is limited by engagement of ears 74 and 75 with elements 190 attached to the ends of inclined brace elements 38 and members 39 and 40 of the carriages. In that outermost position represented in broken lines in FIGS. 6 and 10, the rotary drive pipe 44 of the drilling unit is located directly above and in axial alignment with a stand of pipe 91 located within a mousehole 92 (FIG. 4) formed in front of the pipe string. The axis 93 of this mousehole may extend directly vertically and parallel to the axis 13 of the well and drill pipe, and may be of a depth to contain any desired number of pipe sections connected threadedly together in end to end relation. The present apparatus is not limited to addition of pipe sections as only single joints, but rather may add stands consisting of one, two or three joints.

With drilling unit in its broken line position of FIGS. 4, 6 and 10, motor 65 is energized to screw the tubular element 44 of the drilling unit into connection with the upper end of the stand of pipe in the mousehole. After such connection, and with the drilling unit still in its outward position of alignment with the mousehole axis 93, the drilling unit is pulled upwardly along guide tracks 18 and onto and along the upper longer guide tracks 16, until the entire length of pipe within the mousehole is moved upwardly out of the mousehole and to a level above the upper end of the drill string. This position is illustrated in full lines in FIG. 11. The two motors 79 and 81 are then energized in reverse direction, to move the drilling unit inwardly relative to the carriage structure and to the broken line position of FIG. 11, so that the pipe sections from the mousehole are now directly above and in alignment with the upper end of the drill string. The traveling block is then lowered slightly to move the lower pin end of the pipe sections from the mousehole into the upper end of the drill string, following which the threaded connection may be completed by spinning the added pipe section and then torquing it as necessary. After that connection is made, rotation of motor 65 can drive element 44 and the drill string and carried bit, while drilling fluid is forced downwardly therethrough, to proceed with the drilling operation, and with progressive lowering of the drilling unit as in the first described drilling operation until the FIG. 3 position is again attained. During downward advancement of the drilling unit, additional pipe of the desired length can be placed in the mousehole for connection into the string on the next lengthening operation.

Figure 13:
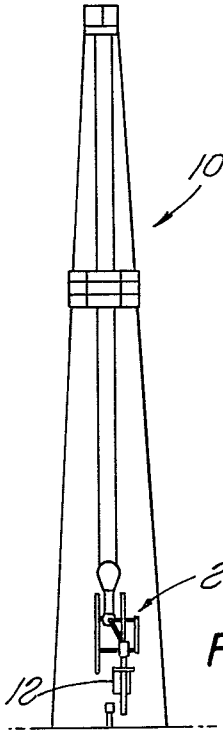
FIGS. 13 and 14 are fragmentary diagrammatic front view illustrations of the apparatus in two additional conditions.
Figure 14:
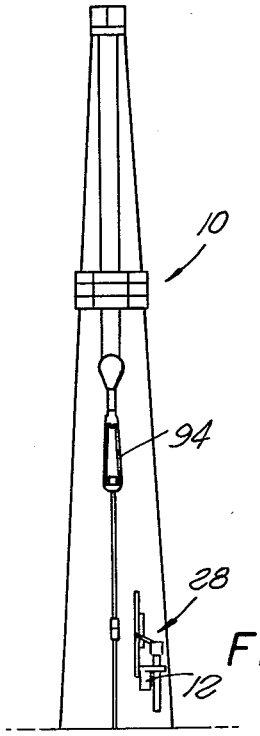

When a round trip of the drill string becomes necessary, the drilling unit of the present invention may be moved to an inactive position as represented in FIGS. 13 and 14, to allow the string to be pulled and reinserted into the well by the traveling block and related equipment. To place the apparatus in this condition, the drilling unit is first lowered along the tracks to the position of FIG. 3 in which the carriages 28 and 29 are connected entirely to the lower sections 18 of the tracks. The track sections 18 and their connected parts, including the carriages and the drilling unit, are then swung about axis 27, as permitted by the pivotal connections 23, 24, 25, and 26, and to the broken line position of FIG. 6. FIG. 13 illustrates the parts during such movement, and FIG. 14 represents the drilling unit in its completely offset position (broken lines of FIG. 6), with the traveling block detached from the swivel, and with an elevator 94 suspended by the traveling block to pull the drill string upwardly to enable detachment of an upper section from the remainder of the string in conventional manner. An entire round trip of the string may be performed while the drilling unit is in its FIG. 14 retracted position, following which the drilling unit may be returned to its active position by swinging of the lower track sections and carried parts to the FIG. 1 condition for a further drilling operation.

While a certain specific embodiment of the present invention has been disclosed as typical, the invention is of course not limited to this particular form, but rather is applicable broadly to all such variations as fall within the scope of the appended claims.

We claim:

1. Well drilling apparatus comprising:

a drilling unit including an element adapted to be connected to the end of a drill string for rotation therewith about the axis of the string, and a motor operable to drive said element and the connected string rotatively about said axis; and means movably mounting said drilling unit and including a guide structure which in a predetermined drilling position of the unit guides it for movement along said axis;

said mounting means being constructed to mount said drilling unit for movement between said drilling position and a laterally offset position in which said drilling unit and said element and motor thereof are shifted to a side of said axis;

said guide structure including two elongated guide elements extending essentially parallel to said axis and having upper and ower portions;

said mounting means including two follower structures carrying said drilling unit and engaging said two guide elements respectively and guided by said elements for movement along said axis, and said mounting means including a connection mounting said lower portion of at least one of said guide elements, carrying one of said follower structures, for pivotal movement relative to said upper portions of said elements and about a generally vertical axis in a relation swinging said drilling unit generally horizontally between said positions thereof.

2. Well drilling apparatus comprising:

a drilling unit including an element adapted to be connected to the end of a drill string for rotation therewith about the axis of the string, and a motor operable to drive said element and the connected string rotatively about said axis; and means movably mounting said drillihg unit and including a guide structure which in a predetermined drilling position of the unit guides it for movement along said axis;

said mounting means being constructed to mount said drilling unit for movement between said drilling position and a laterally offset position in which said drilling unit and said element and motor thereof are shifted to a side of said axis;

said guide structure including two elongated essentially parallel guide elements extending essentially parallel to said axis and having upper and lower portions;

said mounting means including follower structures engaging said guide elements and guided thereby for movement axially therealong and carrying said drilling unit;

said follower structures being movable axially between positions of guided engagement with said upper portions or said lower portions of the guide elements;

said mounting means including means rigidly securing said lower portions of the guide elements together, and a pivotal comnection mounting said lower portions of the guide elements, carrying said follower structures and said drilling unit, for swinging movement generally transversely of said axis relative to said upper portions of the guide elements and between said drilling and laterally offset positions of the drilling unit.

3. Well drilling apparatus comprising:

a drilling unit including an element adapted to be connected to the end of a drill string for rotation therewith about the axis of the string, and a motor operable to drive said element and the connected string rotatively about said axis;

means movably mounting said drilling unit and including a guide structure which in a predetermined drilling position of the unit guides it for movement along said axis;

said mounting means being constructed to mount said drilling unit for movement between said drilling position and a laterally offset position in which said drilling unit and said element and motor thereof are shifted to a side of said axis;

said guide structure including two elongated guide elements extending essentially parallel to one another and to said axis;

said mounting means including two follower structures guided by said guide elements for movement therealong, and sliding connections between said drilling unit and said follower structures mounting the drilling unit for movement relative to the follower structures generally transversely of said axis between said drilling and laterally offset positions of the drilling unit;

latch elements releasably connecting said drilling unit to said follower structures respectively and retaining the drilling unit against movement from said drilling position relative to the follower structures;

two motors carried by said drilling unit; and rack and pinion drives between said motors and said follower structures for powered movement of the drilling unit relative to the follower structures.

4. Well drilling apparatus comprising:

a drilling unit including an element adapted to be connected to the end of a drill string for rotation therewith about the axis of the string, and a motor operable to drive said element and the connected string rotatively about said axis;

means movably mounting said drilling unit and including a guide structure which in a predetermined drilling position of the unit guides it for movement along said axis;

said mounting means being constructed to mount said drilling unit for movement between said drilling position and a laterally offset position in which said drilling unit and said element and motor thereof are shifted to a side of said axis;

said mounting means including means mounting a first portion of said guide structure, carrying said drilling unit, for movement relative to a second portion of said guide structure in a relation moving the drilling unit from said drilling position to said laterally offset position, and additional means mounting said drilling unit for movement generally transversely of said axis relative to said first portion of the guide structure and between said drilling position and a second laterally offset position;

motor means for moving said drilling unit relative to said first portion of the guide structure between said drilling position and said second laterally offset position; and latch means for releasably retaining said drilling unit against movement relative to said first portion of the guide structure between said drilling position and said second laterally offset position.

5. Well drilling apparatus comprising:

a drilling unit including an element adapted to be connected to the end of a drilling string for rotation therewith about the axis of the string, and a motor operable to drive said element and the connected string rotatively about said axis;

means movably mounting said drilling unit and including a guide structure which in a predetermined drilling position of the unit guides it for movement along said axis;

said mounting means being constructed to mount said drilling unit for movement between said drilling position and a laterally offset position in which said drilling unit and said element and motor thereof are shifted to a side of said axis;

said guide structure having an upper portion and a lower portion;

said mounting means including follower means carring said drilling unit and movable along said guide structure and engageable with either said upper portion thereof or said lower portion thereof, a connection mounting said lower portion of the guide structure with the follower means and drilling unit for movement between said drilling position and laterally offset position of the drilling unit, and connecting means attaching said drilling unit to said follower means for movement relative to the follower means between said drilling position and a second laterally offset position of the drilling unit.

6. Well drilling apparatus as recited in claim 5, including powered means for actuating said drilling unit between said drilling and second laterally offset positions relative to the follower menas, and latch means for releasably retaining the drilling unit against movement from said drilling position relative to the follower means.

7. Well drilling apparatus comprising:

a drilling unit including an element adapted to be connected to the end of a drill string for rotation therewith about the axis of the string, and a motor operable to drive said element and the connected string rotatively about said axis;

means movably mounting said drilling unit and including a guide structure which in a predetermined drilling position of the unit guides it for movement along said axis;

said mounting means being constructed to mount said drilling unit for movement between said drilling position and a laterally offset position in which said drilling unit and said element and motor thereof are shifted to a side of said axis;

said guide structure including two vertically extending parallel tracks having relatively long upper portions and shorter lower portions;

said mounting means including two follower structures carrying said drilling unit and guided by said tracks for movement therealong and receivable in upper positions on said upper portions of the tracks and in lower positions on said lower portions of the tracks, means connecting said lower portions of the tracks rigidly together, a pivotal connection mounting said lower portions of the tracks for swinging movement with said follower structures and the drilling unit relative to said upper portions of the tracks and between positions in which said lower portions of the tracks are aligned with said upper portions of the tracks and said drilling unit is in its drilling position and said laterally offset position of the drilling unit, and connections between said drilling unit and said follower structures mounting the drilling unit for linear movement generally transversely of said axis between said drilling position and a mousehole position of the drilling unit offset from said first mentioned laterally offset position;

motor means for actuating said drilling unit from said drilling position to said mousehole relative to said follower structures; and two latch elements releasably connecting said drilling unit to said follower structures respectively and retaining the drilling unit against movement from said drilling position relative to the follower structures.

8. Well drilling apparatus comprising:

a drilling unit including an element adapted to be connected to the end of a drill string for rotation therewith about the axis of the string, and a motor operable to drive said element and the connected string rotatively about said axis; and means mounting said drilling unit for movement between a drilling position in which said element is aligned with and movable along said axis, a second position in which the element can pick up or deposit a length of pipe offset from the axis, and a third position different than said second position in which the drilling unit and said element and motor thereof are retracted to a side of the axis;

said mounting means including an elongated guide structure guiding said drilling unit for said movement along said axis in said drilling position thereof;

said guide structure including two elongated guide elements extending essentially parallel to said axis and along which said drilling unit is movable and having upper and lower portions;

said mounting means including two follower structures carrying said drilling unit and engaging said two guide elements respectively and guided by said elements for movement along said axis, and a connection mounting said lower portion of at least one of said guide elements carrying one of said follower structures for pivotal movement relative to said upper portions of said guide elements and about a generally vertical axis in a relation swinging said drilling unit generally horizontally between said first and third positions thereof.

9. Well drilling apparatus comprising:

a drilling unit including an element adapted to be connected to the end of a drill string for rotation therewith about the axis of the string, and a motor operable to drive said element and the connected string rotatively about said axis; and means movably mounting said drilling unit and including an elongated guide structure which extends essentially parallel to said axis and which in a predetermined drilling position of the unit guides it for movement along said axis relative to said guide structure;

said mounting means including a connection mounting a first portion of said elongated guide structure, carrying said drilling unit, for movement with the drilling unit relative to a second portion of the guide structure in a relation shifting said drilling unit between said drilling position and a laterally offset position in which said drilling unit is shifted to a side of said axis.

10. Well drilling apparatus as recited in claim 9, in which said connection mounts said first portion of said guide structure, carrying said drilling unit, for pivotal movement relative to said second portion of said guide structure in a relation swinging said drilling unit between said positions thereof.

11. Well drilling apparatus as recited in claim 9, in which said connection is a pivotal connection mounting said first portion of said guide structure, carrying said drilling unit, for pivotal movement about a generally vertical axis relative to said second portion of said guide structure in a relation swinging said drilling unit generally horizontally relative to said second portion of the guide structure between said drilling and laterally offset positions.

12. Well drilling apparatus as recited in claim 9, in which said mounting means include a follower structure carrying said drilling unit and engaging said guide structure and guided thereby for movement with the drilling unit along said axis, and which is movable with said first portion of the guide structure and said drilling unit relative to said second portion of the guide structure between said drilling and laterally offset positions of the drilling unit.

13. Well drilling apparatus comprising:

an upwardly projecting drill rig mast;

hoisting mechanism suspended by said mast and operable to support the weight of a drill string extending along a predetermined axis and move the string upwardly and downwardly;

a mousehole offset from said axis for holding a pipe section to be added to or which has been removed from the string;

a drilling unit including an element adapted to be connected to the end of the drill string for rotation therewith about said axis of the string, and a motor operable to drive said element and the connected string rotatively about said axis; and means movably mounting said drilling unit and including a plurality of elongated tracks extending essentially parallel to said axis and which in a predetermined drilling position of the unit guide it for movement along said axis;

said mounting means including means mounting a lower portion of at least one of said tracks, carrying said drilling unit, for pivotal movement about a generally vertical axis with the drilling unit relative to an upper portion of the same track in a relation swinging the drilling unit generally horizontally between said drilling position and a laterally offset position in which said drilling unit and said element and motor thereof are shifted to a side of said axis and do not obstruct upward or downward movement of said string along said axis by said hoisting mechanism;

said mounting means being constructed to also mount said drilling unit for movement between said drilling position and a second laterally offset position different than said first laterally offset position and in which said element is above and aligned with said mousehole.

14. Apparatus for drilling a well along a predetermined axis by rotation of a drill string about said axis comprising:

an upwardly projecting drill rig mast;

a drilling unit including an element adapted to be connected to the end of said drill string for rotation therewith about the axis of the string, and a motor operable to drive said element and the connected string rotatively about said axis; and means mounting said drilling unit for movement relative to said mast and including an elongated guide structure which in a predetermined drilling position of the unit guides it for movement along said axis to drill a well;

said means being constructed to also mount said drilling unit for lateral movement relative to said mast along a first path from said drilling position to a first laterally offset position at a first side of said axis in which the drilling unit does not obstruct movement of the drill string into or out of the well along said axis by other equipment suspended from the mast, and for additional lateral movement relative to the mast along a second path to a second laterally offset position, at a second side of said axis in which said element can pick up a length of pipe offset from said axis;

said mounting means including means mounting a first portion of said guide structure carrying said drilling unit for movement relative to a second portion thereof in a relation moving said drilling unit to one of said laterally offset positions.

15. Apparatus for drilling a well along a predetermined axis by rotation of a drill string about said axis comprising:

an upwardly projecting drill rig mast;

a drilling unit including an element adapted to be connected to the end of said drill string for rotation therewith about the axis of the string, and a motor operable to drive said element and the connected string rotatively about said axis; and means mounting said drilling unit for movement relative to said mast and including an elongated guide structure which in a predetermined drilling position of the unit guides it for movement along said axis to drill a well;

said means being constructed to also mount said drilling unit for lateral movement relative to said mast along a first path from said drilling position to a first laterally offset position at a first side of said axis in which the drilling unit does not obstruct movement of the drill string into or out of the well along said axis by other equipment suspended from the mast, and for additional lateral movement relative to the mast along a second path to a second laterally offset position, at a second side of said axis in which said element can pick up a length of pipe offset from the axis;

said mounting means including means mounting a first portion of said guide structure near the lower end thereof carrying said drilling unit for pivotal movement relative to an upper portion of the guide structure and about a generally vertical axis in a relation swinging the drilling unit generally horizontally between said drilling position and said first laterally offset position.

16. Apparatus as recited in claim 15, in which said means mounting said driling unit for movement relative to said mast include means mounting said drilling unit for movement relative to said first portion of the guide structure to said second laterally offset position.

17. Apparatus as recited in claim 14, in which said mounting means include means mounting said drilling unit for movement relative to said first portion of the guide structure to said second laterally offset position.

18. Well drilling apparatus comprising:

an upwardly projecting drill rig mast;

hoisting mechanism suspended by said mast and operable to support the weight of a drill string extending along a predetermined axis and move the string upwardly and downwardly;

a mousehole offset from said axis for holding a pipe section to be added to or which has been removed from the string;

a drilling unit including an element adapted to be connected to the end of said drill string for rotation therewith about the axis of the string, and a motor operable to drive said element and the connected string rotatively about said axis; and means mounting said drilling unit for movement relative to said mast and including an elongated guide structure which in a predetermined drilling position of the unit guides it for movement along said axis to drill a well;

said means being constructed to also mount said drilling unit for lateral movement relative to said mast along a first path from said drilling position to a first laterally offset position at a first side of said axis in which the drilling unit does not obstruct movement of the drill string into or out of the well along said axis by said hoisting mechanism suspended from the mast, and for additional lateral movement relative to the mast along a second path to a second laterally offset position, different than said first laterally offset position and at a second side of said axis, and in which said element is above and aligned with said mousehole;

said guide structure being constructed to guide said drilling unit for movement axially of said mousehole in said second laterally offset position of the drilling unit.

19. Apparatus as recited in claim 18, including powered means for moving said drilling unit between said drilling position and said second laterally offset position.

20. Apparatus for drilling a well by rotation of a drill string about an axis comprising:

an upwardly projecting drill rig mast;

a drilling unit including an element adapted to be connected to the end of said drill string for rotation therewith about the axis of the string, and a motor operable to drive said element and the connected string rotatively about said axis; and means mounting said drilling unit for movement relative to said mast and including an elongated guide structure which extends essentially parallel to said axis and which in a predetermined drilling position of the unit guides it for movement along said axis relative to the guide structure to drill a well;

said mounting means including a connection mounting at least a portion of said guide structure, carrying said drilling unit, for movement with the drilling unit relative to said mast in a relation shifting said drilling unit between said drilling position and a laterally offset position in which said drilling unit is shifted to a side of said axis.

21. Well drilling apparatus comprising:

an upwardly projecting drill rig mast;

hoisting mechanism suspended by said mast and operable to support the weight of a drill string extending along a predetermined axis and move the string upwardly and downwardly;

a mousehole offset from said axis for holding a pipe section to be added to or which has been removed from the string;

a drilling unit including an element adapted to be connected to the end of said drill string for rotation therewith about the axis of the string, and a motor operable to drive said element and the connected string rotatively about said axis; and means mounting said drilling unit for movement relative to said mast and including an elongated guide structure which in a predetermined drilling position of the unit guides it for movement along said axis to drill a well;

said means being constructed to also mount said drilling unit for lateral movement relative to said mast along a first path from said drilling position to a first laterally offset position at a first side of said axis in which the drilling unit does not obstruct movement of the drill string into or out of the well along said axis by said hoisting mechanism suspended from the mast, and for additional lateral movement relative to the mast along a second path to a second laterally offset position, different than said first laterally offset position and at a second side of said axis, and in which said element is above and aligned with said mousehole;

said guide structure being constructed to guide said drilling unit for movement axially of said mousehole in said second laterally offset position of the drilling unit;

said means including means mounting at least a portion of said guide structure carrying said drilling unit for movement with the drilling unit relative to said drill rig mast in a relation moving said drilling unit to one of said laterally offset positions.

22. Well drilling apparatus comprising:

a drilling unit including an element adapted to be connected to the end of a drill string for rotation therewith about the axis of the string, and a motor operable to drive said element and the connected string rotatively about said axis; and means movably mounting said drilling unit and including a guide structure which in a predetermined drilling position of the unit guides it for movement along said axis;

said mounting means including a connection mounting a first portion of said guide structure, carrying said drilling unit, for movement with the drilling unit relative to a second portion of the guide structure in a relation shifting said drilling unit between said drilling position and a laterally offset position in which said drilling unit is shifted to a side of said axis;

said mounting means including means mounting said drilling unit for movement generally transversely of said axis relative to said first portion of the guide structure and between said drilling position and a second laterally offset position.

* * * * *